US005366086A

United States Patent [19]

Weerth et al.

[11] Patent Number: 5,366,086

[45] Date of Patent: Nov. 22, 1994

[54] CONTAINER FOR TUBULAR AND ROD-SHAPED WORKPIECES

[76] Inventors: Hans E. Weerth, Simriweg 6, D-7967 Bad Waldsee-Reute; Wolfgang Krug, Reinhold-Abele-Strasse 22, D-7981 Waldburg, both of Germany

[21] Appl. No.: 838,272

[22] PCT Filed: Sep. 13, 1990

[86] PCT No.: PCT/DE90/00706

§ 371 Date: Mar. 30, 1992

§ 102(e) Date: Mar. 30, 1992

[87] PCT Pub. No.: WO91/04203

PCT Pub. Date: Apr. 4, 1991

[30] Foreign Application Priority Data

Sep. 15, 1989 [DE] Germany ..... 3930920
Mar. 17, 1990 [DE] Germany ..... 4008683

[51] Int. Cl.[5] ..... B65D 85/20

[52] U.S. Cl. ..... 206/443; 206/451; 206/509; 206/511

[58] Field of Search ..... 206/443, 446, 386, 451, 206/452, 583, 503, 509, 511

[56] References Cited

U.S. PATENT DOCUMENTS 1,463,512 7/1923 Leach ..... 206/452
1,714,692 5/1929 Pagel ..... 206/451
1,772,734 8/1930 Romine ..... 206/452
1,920,837 8/1933 Birdsey ..... 206/452
3,583,623 9/1969 Golner ..... 220/608
4,013,170 3/1977 Hutterer ..... 206/583
4,016,976 4/1977 Cosper ..... 206/583
4,442,969 4/1984 Holden ..... 220/608

FOREIGN PATENT DOCUMENTS 2192538 8/1974 France .
3719071 8/1988 Germany .
1424113 2/1976 United Kingdom .

*Primary Examiner*—David T. Fidei
*Attorney, Agent, or Firm*—Smith-Hill and Bedell

[57] ABSTRACT

A transport container comprises two container components forming opposite side walls of the container for receiving opposite respective ends of tubular or rod-shaped workpieces. Each container component is in the shape of a half shell with a generally flat shell floor having first and second opposite edges and two opposite side edges, a circumferential shell wall open on the first edge, and foot supports extending from the shell wall at the second edge. Attachment elements are located on the side edges of the container components for attachment of tension devices for urging the container components towards each other.

7 Claims, 7 Drawing Sheets

CONTAINER FOR TUBULAR AND ROD-SHAPED WORKPIECES

BACKGROUND OF THE INVENTION

The invention involves a container for tubular and rod-shaped production parts, preferably for parts 150–1500 mm long.

Containers with fixed dimensions, such as gitter boxes, are usually used as containers for tubular and rod-shaped work pieces. The disadvantage of such containers with fixed dimensions is that they cannot be used for work pieces of various lengths. Unless they are loaded very carefully, the work pieces roll back and forth when they are being transported and can thus be damaged. Loading and unloading unfortunately has to be done from above and over the edge of the container. Transportation of empties wastes a lot of space.

Containers with fixed dimensions, such as gitter boxes, are also not suitable for loading or unloading with a work piece magazine per DE-PS 34 20 014 with at least one pair of carrying straps going through under the work pieces and forming an open web sling above, since the carrying strap cannot be taken in and out and the work pieces of varying lengths cannot be guided by their ends.

In order to store rod-shaped work pieces in a container in an orderly and compact fashion, one that can also be maintained during transport or when jostled, it is possible per DE-PS 37 19 071 to adjust (without any stops) the length of a container for work pieces of varying lengths by turning the threaded spindles of a joint-rod system connecting two container frame parts. Fixed limiting walls hold the work pieces by their ends to the container frame parts. Since these limiting walls can be disassembled and are held away from the container frame parts by fasteners firmly connected to them, loading and unloading via the work pieces magazine per DE-PS 34 20 014 is possible, since the carrying strap can be placed under the protruding ends of the work pieces without being obstructed and removed again from there.

The adjustable-length container described is costly because of its engineering and is prone to failure when roughly handled.

Packing for bundles of glass tubes is prior art per DE-GM 79 26 752 and consists of two identical rectangular caps made from pressed plastic, the interior surfaces of which hold the ends of the bundles of glass tubes. They also have tightening bands in the shape of a closed ring, which can be placed around both end caps under tension. However, this type of packing is non-specific to a loadable and unloadable transport container intended for a variety of work pieces.

SUMMARY OF THE INVENTION

The purpose of the invention is to create a container suitable for work pieces of varying lengths, which can be produced cost-effectively, can be easily handled and offers the best possible protection for the work pieces loaded into it.

The container consists of two container components that surround the work pieces on their ends. The two container components are identical in form and design. They are shaped like a half shell with a basically level shell floor and a continuous, one-sided shell edge that is open on top. The two container parts are held together with a tension component, with the container parts having band guides to guide a tension band or belt that is laid or fastened around the two container components that encircle the work pieces on their ends. The container components for the purpose are made from impact and scratch resistant plastic, but they can also be made from metal. To increase rigidity, the shell floor has diagonal ribs or is made rigid in some other suitable way.

A container made from container components according to invention is extremely simple and cost-effective to produce. All the container components are identical in shape and design regardless of the length of the work pieces. The container components are lightweight and, when designed in plastic, create very little noise when being handled. The container components offer the best possible protection during transport since the work pieces are fixed in place. When the empty container components are nested together they take up very little room during empty running. By designing the band guides accordingly and because of the feet on the container components, it is possible to stack filled and braced containers, both lying on their sides and, if work pieces are the same length, standing up.

Loading and unloading can be done by hand using suitable auxiliary equipment, in which case the work pieces can be put in or taken out laterally. Loading and unloading can also be done with a work piece magazine per DE-PS 34 20 014, in that the container components can be fixed by means of click stops.

Common stacking equipment can be used for transport. Eye holds attached or molded onto the container components are used for transportation by crane.

BRIEF DESCRIPTION OF THE DRAWINGS

The invention is explained in more detail below, using the attached drawings.

DETAILED DESCRIPTION

Figure 1:
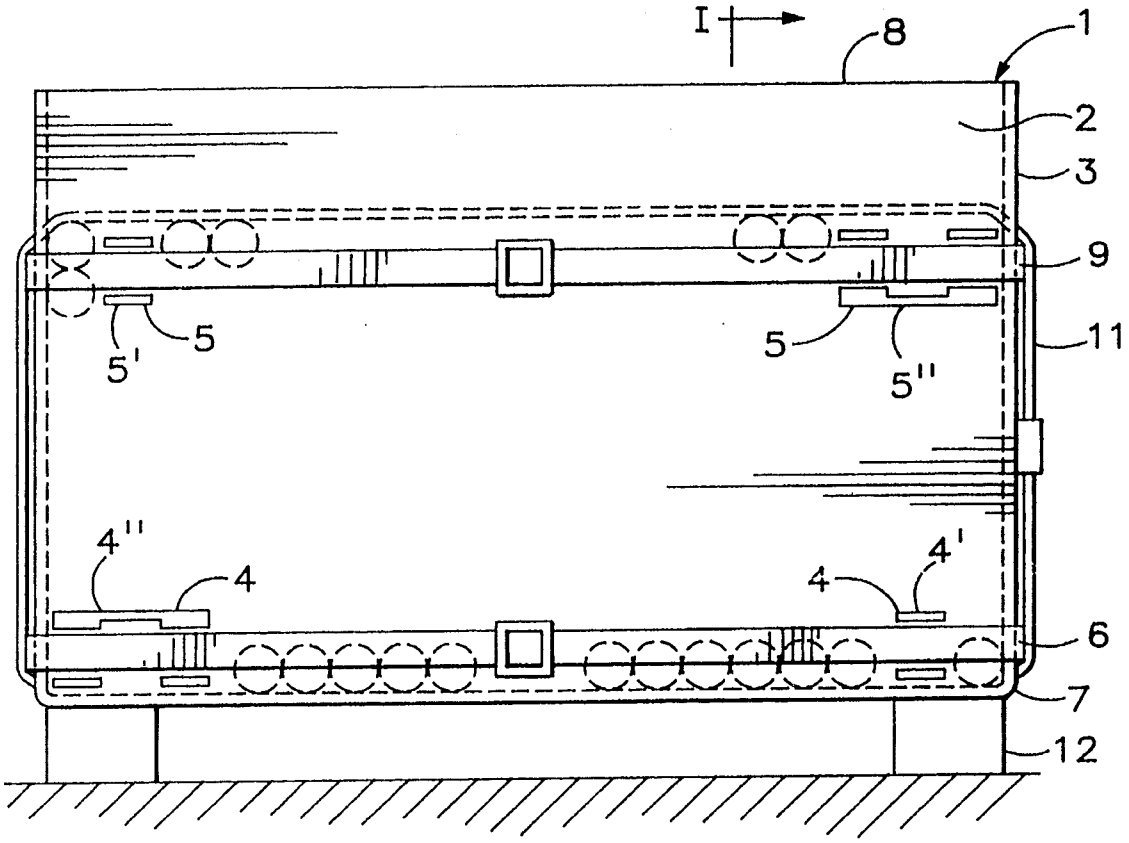
FIG. 1 is a side view of a container according to one of the first design examples filled with work pieces and braced.
Figure 2:
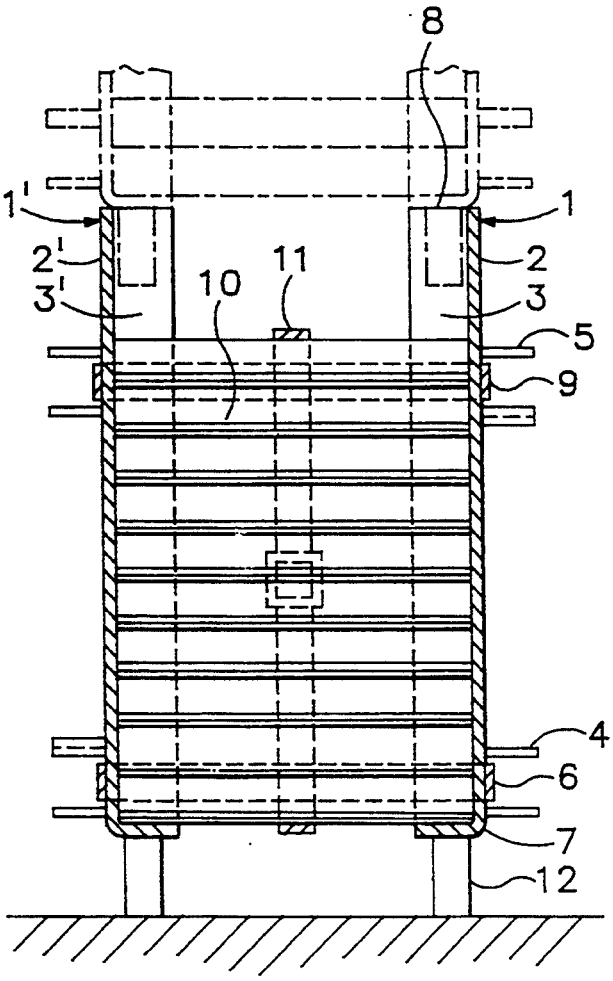
FIG. 2 is a sectional view along line I—I in FIG. 1, with another container for work pieces of the same length stacked above and indicated by dotted lines.

As shown in FIGS. 1 and 2, a complete container consists of two container components 1, 1', identical in form and design. Each container component 1, 1' is formed as a half shell with a generally flat floor 2, 2' and a one-sided (i.e. open at the top) shell edge 3, 3' The height h of the shell edge 3, 3+ is a maximum of half the size of the shortest work piece to be stored. On the back or shell floor 2, 2' of the container component 1, 1', strap guides 4, 5 are molded or welded on. One strap guide 4 guides a steel or plastic tightening strap 6 or belt to just above and parallel to one edge of the floor 7 of the half shell (opposite the open side 8 of the shell edge 3). The other strap guide 5 guides a second tightening strap 9 to the upper part of the half shell parallel to the first tightening strap 6. Tightening straps 6 and 9 are placed around the two container components 1, 1' surrounding the work pieces 10 on their ends and tightened. To prevent the work pieces 10 held tightly by friction between the container components 1, 1' from slipping out toward the open side 8 when a container is lying on its side, a third tightening strap 11 is provided to tighten transversely over the work pieces 10 braces by their ends between the two container components 1, 1'.

The strap guides 4, 5 are designed and positioned on the back of the half shell, as shown in FIG. 1, so that they fit into one another when the half shells are stacked back to back and prevent the half shells or container components 1, 1' from shifting. As shown, the strap guides 4, 5 are designed as tongues projecting from the rear of a half shell or as U-shaped fixtures 4", 5" surrounding the tongues. The length of projection 1 of the strap guides 4, 5 is less than the height h of the shell edges 3 and the strap guides 4, 5 are also designed close to these shell edges 3 so that when the empty half shells are stacked back to inside the strap guides 4, 5 behind the shell edges 3 engage and prevent the half shells or container components from shifting against each other toward three sides.

As seen particularly well in FIG. 2, extending from the edge of the floor 7 of the half shell are feet 12. These feet 12 engage behind the shell side edges 3 and the shell floor 2 when the containers filled with work pieces of the same length are stacked on top of one another and prevent the stacked containers from shifting against each other.

Figure 3:
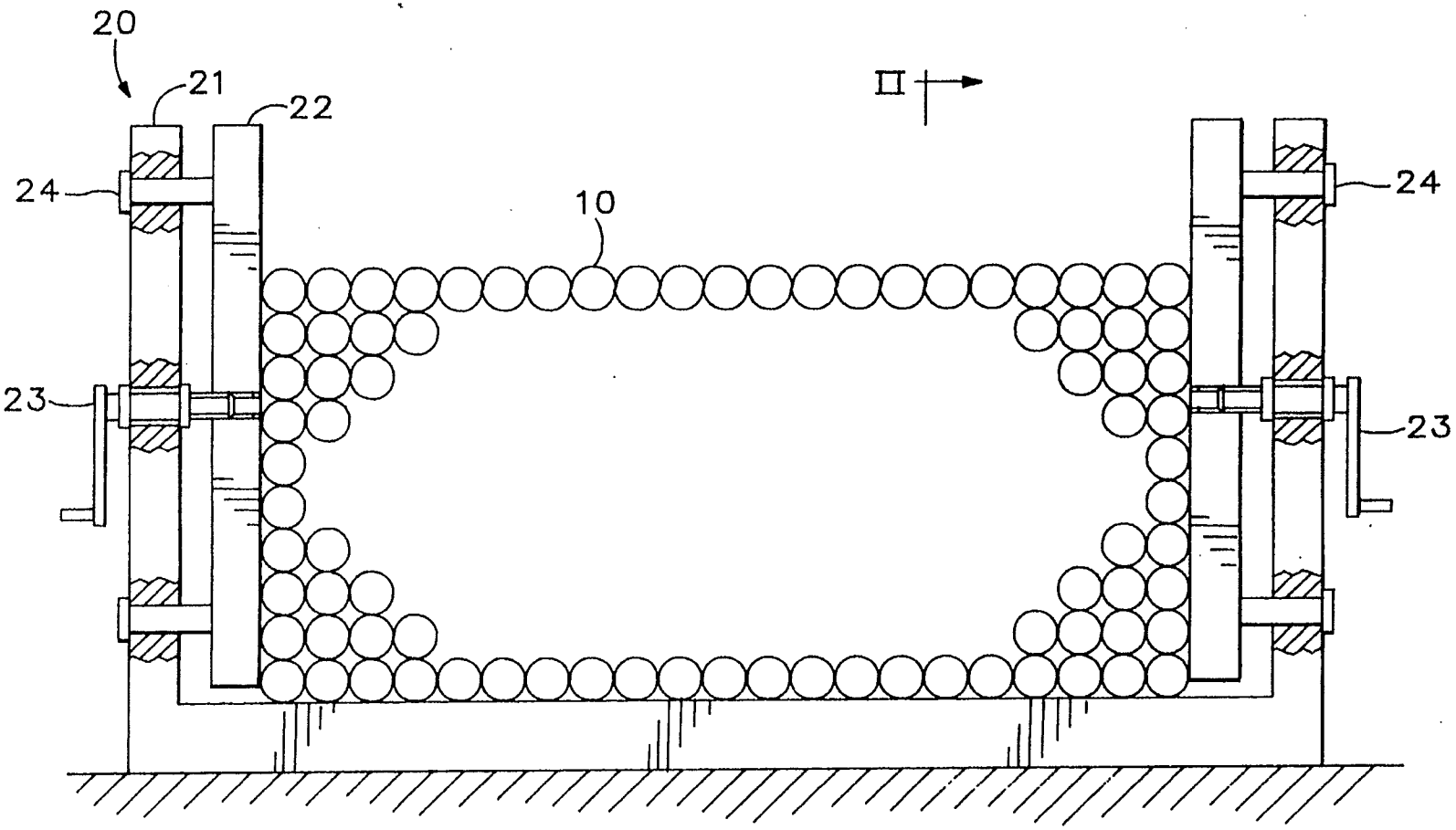
FIG. 3 is a side view of auxiliary equipment for manually loading and unloading a container according to invention.
Figure 4:
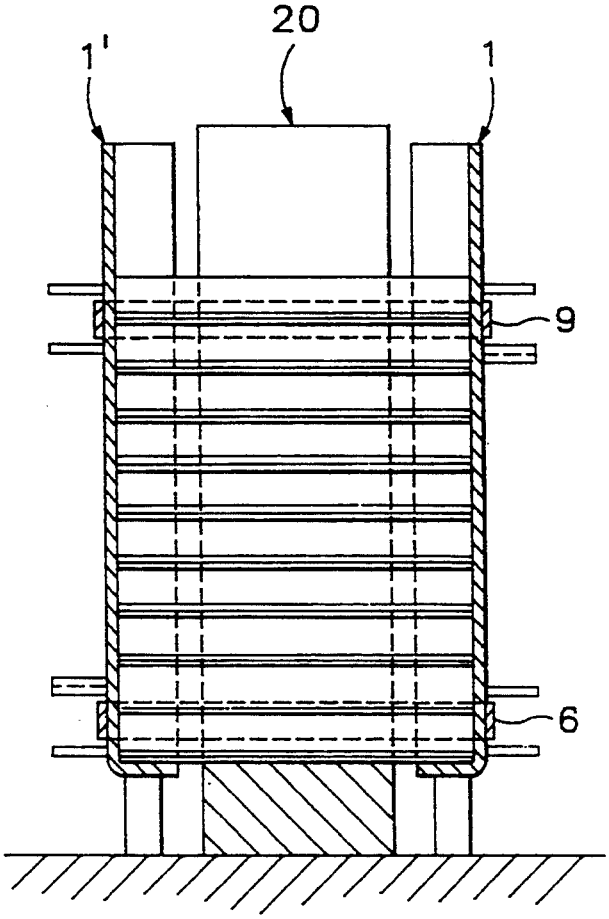
FIG. 4 is a sectional view along line II—II in FIG. 3, with braced container components surrounding the work pieces on their ends.

FIGS. 3 and 4 show auxiliary equipment 20 for loading and unloading a container consisting of container components according to invention. This auxiliary device 20 has a U-shaped base frame 21, for example, open on both sides, with laterally adjustable stop bars 22, in which the work pieces 10 can be laid with a central support. The stop bars 22 are adjusted, for example, by hand cranks 23, with guide bolts 24 ensuring guidance on the base frame. To load the container components 1, 1', the work pieces 10 are stacked in the auxiliary device so that they lie laterally against the adjustable stop bars 22 and on the bottom of the base frame 21. After the device is filled, two container components (FIG. 4) are shoved over the ends of the work pieces so that the work pieces lie on the floor and almost to the edges of the container components. The adjustment space of the stop bars 22 is calculated so that the production pieces stacked in between are surrounded by the container components so they just fit, i.e. with a little room for play.

After the two container components have been put in place, the adjustable stop bars 22 are retracted by turning the hand crank 23, so that an empty space is created between the ends of the work pieces, which rest on the edges of the container components, and the adjustable stop bar. Tightening straps 6 and 9 are laid around the container components 1, 1' and tightened. The braced container pack is raised up out of the device 20 by a crane, after which a transverse tightening strap 11 is put on.

Unloading a container pack is done using the auxiliary device described in the reverse order from loading.

Figure 5:
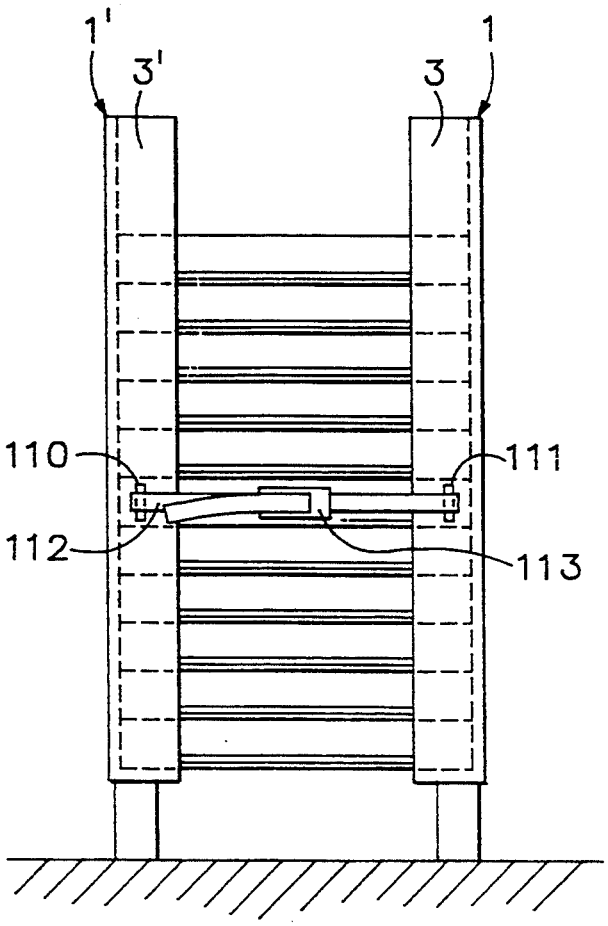
FIG. 5 is a front view of a container according to a second design example filled with work pieces and braced.
Figure 6:
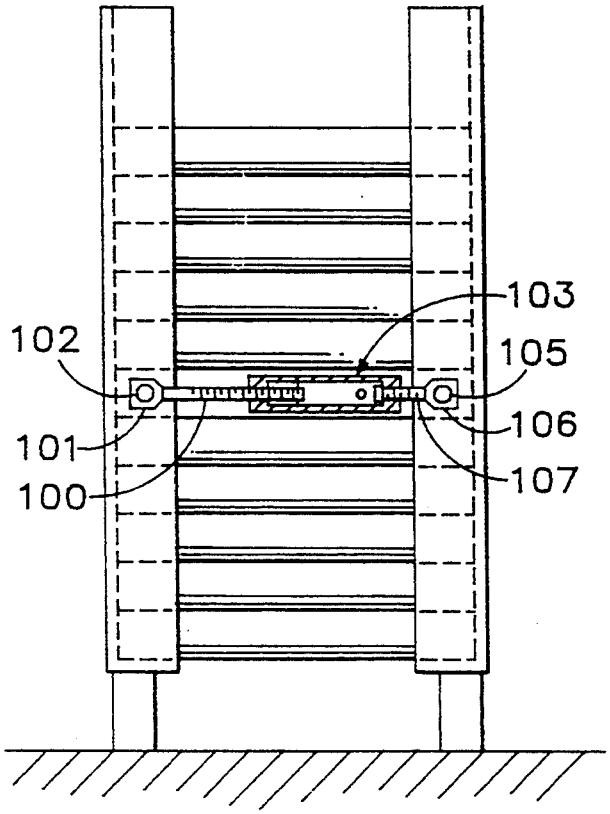
FIG. 6 is a front view of a container according to a third design example filled with work pieces and braced.
Figure 7:
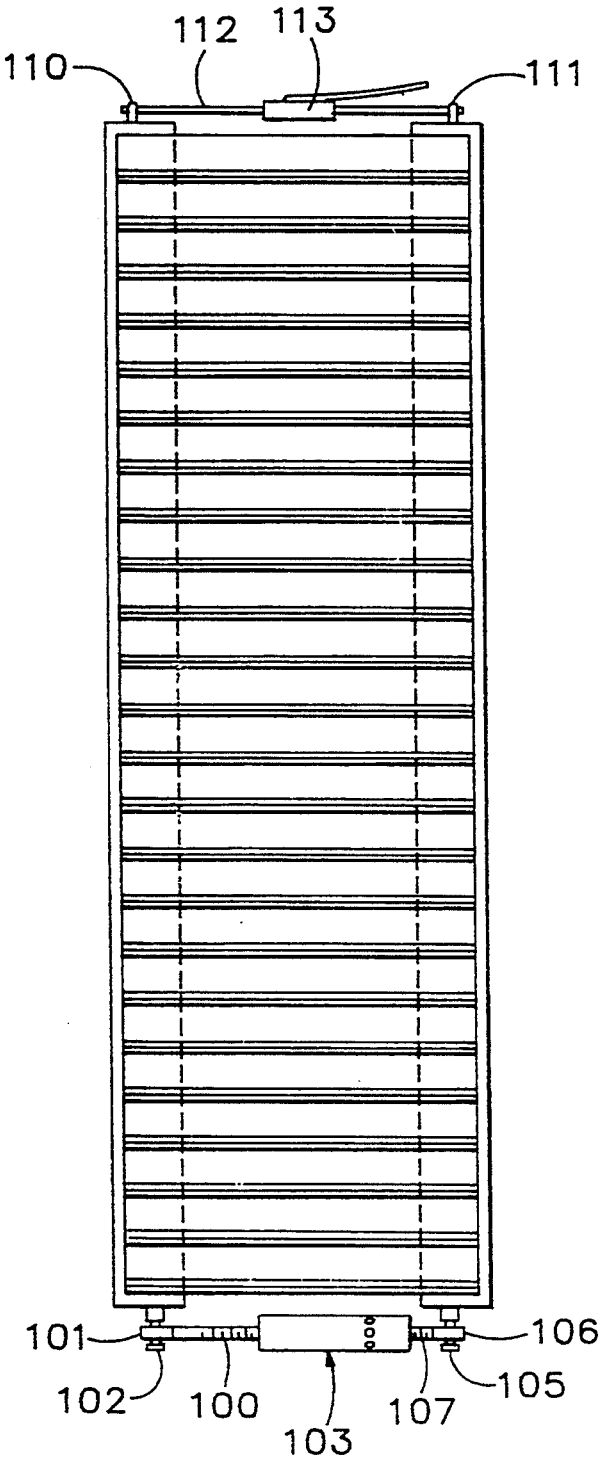
FIG. 7 is a top view of the design examples in FIGS. 5 and 6, which, for the sake of drawing, have been combined into one figure.

Instead of tightening straps or belts being tightened around the container components, tension devices, as depicted in FIG. 5–7, can be attached right onto the lateral edges of the container half shells 1, 1'. In FIGS. 5 and 7 (above) a strap 112 is provided as a tension device. This is pulled through brackets 110, 111 on the container half shells and fed through a turnbuckle 113 and tightened. It is also conceivable to hook the strap 112 on projections, which are attached to the lateral edges of the container half shells, or to make the strap without a turnbuckle and simply knot it. In FIGS. 6 and 7 (below), a turnbuckle 103 is provided as a tension device. Both threaded rods 100 and 107 of this turnbuckle 103 are attached via eyes 101 or 106 in bolts 102 or 105 that stick out from the lateral edges of the container half shells 1, 1'.

Various lengths of work pieces, depending on the length of the threaded rods 100, 107, can be stored. Other rod designs are also possible, for instance with catches.

At least one tension device is provided per container side.

We claim:

1. A transport container for tubular and rod-shaped workpieces, comprising:

two container components forming opposite side walls of the container for receiving opposite respective ends of each workpiece, each container component being in the shape of a half shell with a generally flat shell floor having first and second opposite edges and two opposite side edges, a circumferential shell wall attached to said second edge and said two opposite side edges of said shell floor and open on said first edge, and foot support means for supporting the container, said foot support means extending from the shell wall at said second edge, and attachment elements located on the side edges of the container components for attachment of tension devices for urging the container components towards each other.

2. A container according to claim 1, wherein the container components are made from impact and scratch resistant plastic.

3. A container according to claim 1, wherein the shell floor of each container component is essentially rigid.

4. A container according to claims 1, comprising additional attachment elements located on the container components for attaching the container to a lifting device.

5. A container according to claim 1, wherein the foot support means comprise foot supports that extend from the first edge of the half shell and are spaced from the exterior of the shell floor by a distance that is at least as great as the thickness of the shell floor.

6. A container according to claim 1, wherein the tension devices are flexible and are adjustable in length, whereby the two container components can be moved away from each other subject to limitation in accordance with the length of the tension devices, and are restrained against further movement away from each other.

7. A container according to claim 1, wherein the tension devices are tension straps, belts, or buckles.

* * * * *